US007213774B1

(12) United States Patent
Kitajima

(10) Patent No.: US 7,213,774 B1
(45) Date of Patent: May 8, 2007

(54) AIR BRUSH

(75) Inventor: Katsuaki Kitajima, Nagano (JP)

(73) Assignee: B. B. Rich Co., Ltd., Nagano-ken (JP)

( * ) Notice: Subject to any disclaimer, the term of this patent is extended or adjusted under 35 U.S.C. 154(b) by 0 days.

(21) Appl. No.: 11/484,637

(22) Filed: Jul. 12, 2006

(30) Foreign Application Priority Data

May 10, 2006 (JP) ..... 2006-131122

(51) Int. Cl.

| | |
|---|---|
| ***B05B 7/30*** | (2006.01) |
| ***B05B 7/06*** | (2006.01) |
| ***B05B 1/00*** | (2006.01) |
| ***B05B 11/00*** | (2006.01) |
| ***B05B 7/24*** | (2006.01) |

(52) U.S. Cl. ..... 239/346; 239/345; 239/353; 239/414; 239/423; 239/424; 239/600

(58) Field of Classification Search ..... 239/346, 239/345, 353, 414, 423, 424, 600, 290, 302, 239/340, 369, 371, 376–378, 398, 407, 413, 239/416.4, 416.5, 418, 525, 527, DIG. 14
See application file for complete search history.

(56) References Cited

U.S. PATENT DOCUMENTS

| | | | | |
|---|---|---|---|---|
| 1,703,359 | A * | 2/1929 | Paasche | 239/353 |
| 2,460,529 | A * | 2/1949 | Paasche | 251/246 |
| 4,161,289 | A * | 7/1979 | Rebold | 239/346 |
| 5,094,400 | A * | 3/1992 | Ching | 239/341 |
| 5,722,950 | A * | 3/1998 | Fujita et al. | 604/48 |
| 5,927,602 | A * | 7/1999 | Robisch et al. | 239/1 |
| 6,354,517 | B1 * | 3/2002 | Wu | 239/353 |
| 6,425,536 | B2 * | 7/2002 | Namura | 239/390 |
| 6,431,466 | B1 * | 8/2002 | Kitajima | 239/346 |
| 6,691,931 | B2 * | 2/2004 | Kitajima | 239/346 |
| 6,779,742 | B2 * | 8/2004 | Kitajima | 239/290 |
| 7,070,124 | B1 * | 7/2006 | Juo | 239/345 |
| 2006/0255178 | A1 * | 11/2006 | Juo | 239/288 |
| 2006/0266848 | A1 * | 11/2006 | Juo | 239/346 |

* cited by examiner

*Primary Examiner*—Frederick C. Nicolas
*Assistant Examiner*—Darren Gorman
(74) *Attorney, Agent, or Firm*—Bacon & Thomas, PLLC

(57) ABSTRACT

An air brush having a simple structure which can be easily disassembled and assembled without use of any particular tool, for improvement in maintenance performance. In the air brush, a needle to open/close a nozzle member is inserted through an air brush main body. Compressed air supplied from an air valve is blown out of the nozzle member. The compressed air is introduced to the nozzle member and sprayed, with supplied paint, by operation of a finger hooking mechanism. The air brush main body and a tail case are connected via a screw connection member, and a needle chuck is fit-inserted and supported unrotatably but withdrawably. A spring case is fitted around an outer periphery of the needle chuck and screw-engaged in a rear opening of the screw connection member, and a coil spring is elastically set in the spring case. A needle stopper screw is screw-engaged with the needle chuck projected rearward from the spring case.

6 Claims, 5 Drawing Sheets

AIR BRUSH

BACKGROUND OF THE INVENTION

The present invention relates to an air brush, and more particularly, to an air brush where a disassembly operation of an air brush main body can be easily performed.

DESCRIPTION OF RELATED ART

FIG. 5 shows a conventional air brush. This air brush 100 is a trigger type air brush having an approximately long-cylindrical air brush main body 101 with a nozzle member 102 at its end. Further, a needle 103 is inserted reciprocably along the axial center inside the air brush main body 101.

In the air brush 100, compressed air is supplied to an air supply orifice 104 connected with an intermediate part of the air brush main body 101. The compressed air is introduced via an air valve 105 to a ventilation path 112 in the air brush main body 101, and blown out of the nozzle member 102. Note that the air valve 105 is opened by depression of a valve stem 105*a*.

The air brush 100 has a finger hooking lever 106 in the intermediate part of the air brush main body 101. A slide cam 107 placed inside the air brush main body 101 is slid in a withdrawal direction and a needle chuck 108 in contact with the rear end of the slide cam 107 is withdrawn by triggering the finger hooking lever 106.

The above needle chuck 108 is inserted through the axial center of a body ring 110 engaged in a rear end opening of the air brush main body 101, and is supported slidably in the withdrawal direction. Further, a groove 108*a* for rotation stop expanded in an axial direction is formed around the outer periphery of the needle chuck 108. An end of a stopper screw 115 screw-engaged from the outside of the rear part of the air brush main body 101 is engaged in the groove 108*a*, thereby the needle chuck 108 is supported unrotatably but withdrawably toward the axial direction.

A spring case 112 is screw-engaged between the rear end of the air brush main body 101 and a tail case 111 so as to detachably connect the air brush main body 101 with the tail case 111. Further, a coil spring 113 to always push the needle chuck 108 and the needle 103 in a frontward direction is elastically set inside the tail case 111. A holder part of the needle chuck 108 projected from the rear end of the needle chuck 108 is a chuck member 114 screw-engaged with a chuck screw 116 to hold the needle 103. Note that the chuck member 114 and the rear end of the needle 103 are covered with the above tail case 111.

To use the air brush 100 having the above structure always in good condition, it is necessary to periodically perform maintenance such as disassembly of the air brush to clean the needle and the nozzle member and grease up of an air-tight portion. The disassembly work is very troublesome for an inexperienced user.

Upon maintenance, to disassemble the air brush 100, first, the tail case 111 is removed, the chuck screw 116 of the chuck member 114 is turned and removed, then the needle 103 is pulled out carefully. When further disassembly is required, the spring case 112 is removed from the air brush main body 101, and the needle chuck 108 and the coil spring 113 are removed. In this state, the body ring 110 appears inside the rear end opening of the air brush main body 101.

However, to remove the body ring 110 screw-engaged inside the air brush main body 101, it is necessary to remove the stopper screw 115 as a rotation stopper with a comparatively small driver, then insert an appropriately large minus driver from the rear end opening of the air brush main body 101 to remove the body ring 110 by moving the body ring 110 back while turning the body ring 110.

Since this operation is troublesome for the user who is unaccustomed to the disassembly work, in many cases, such user gives up the disassembly when the spring case 112 has been removed. A very few users can remove the body ring 110 then remove the slide cam 107, a valve rod 118 to open/close the air valve 105, and a Teflon (registered trademark)-coated stopper 117 to keep a liquid sealed state of the needle 103. Accordingly, many users use the air brush for a long period without maintenance of the inside of the air brush main body, and such use causes degradation of functions and hastens breakage.

Note that the existence of a document related to air brush main body disassembly structure in the air brush as described above is unknown.

SUMMARY OF THE INVENTION

The present invention has been made in consideration of the above-described conventional art, and provides an air brush having a structure which can be easily disassembled and assembled in a simple form, without use of any particular tool as in the case of the conventional air brushes.

Accordingly, as a first aspect of the invention, provided is an air brush, in which a needle to open and close a nozzle member is inserted reciprocably in an axial direction, along an axial center of an approximately long-cylindrical air brush main body having the nozzle member at its end, compressed air supplied via an air valve provided in an intermediate part of the air brush main body is blown out of the nozzle member, the air valve is opened and the compressed air is introduced into the nozzle member by operation of a finger hooking mechanism provided in the intermediate part of the air brush main body, and the needle is withdrawn in the axial direction to spray paint supplied to the nozzle member, with the compressed air, wherein a screw connection member is provided between the air brush main body and a tail case connected with a rear part of the air brush main body so as to detachably screw-connect both members, and a needle chuck to hold the needle inserted therein is inserted from a rear position to abut on the axial center of the screw connection member and supported unrotatably but withdrawably in the axial direction; a spring case is fitted around an outer periphery of the needle chuck and is screw-engaged in a rear opening of the screw connection member, and a coil spring is elastically set in the spring case to always push the needle chuck toward a frontward direction; and a needle stopper screw is screw-engaged with the needle chuck projected from the spring case in a rearward direction.

The finger hooking mechanism has a trigger type or a push-button type structure. Any other existing mechanism can be used as long as the trigger, button or the like is operated with a hooked finger thereby the needle is moved in the axial direction to open the nozzle, and the valve opening is controlled in proportion to the nozzle opening.

Further, as a second aspect of the invention, in the above-described air brush, the finger hooking mechanism is a trigger type mechanism. The trigger type finger hooking mechanism has a trigger-type lever, a slide cam provided in the air brush main body slidably by the operation of the lever, and a spring to push the slide cam, and the like. The needle and the air valve are operated by triggering the lever.

Further, as a third aspect of the invention, in the above-described air brush, the finger hooking mechanism is a push-button type mechanism. The push-button type finger hooking mechanism has a push button on which a finger is hooked, an operation stick, an operation plate, and the like. The needle and the air valve are operated by depression of the button to pull the stick.

Further, as a fourth aspect of the invention, in the above-described air brush, the cross-sectional shape of a fit-insertion member of the needle chuck and an engagement hole of the screw connection member which the fit-insertion member fits and inserts is a regular polygonal shape. The structure to support the needle chuck unrotatably but slidably in a withdrawal direction can be simplified. Accordingly, disassembly and assembly operations can be easily performed. Further, since it is not necessary to form an engagement groove along the needle chuck and insert a stopper screw between members as in the case of the conventional air brushes, the number of parts can be reduced, and the labor of such work can be reduced.

BRIEF DESCRIPTION OF THE DRAWINGS

The above and other object, features and advantages of the present invention will become more apparent from the following detailed description when taken in conjunction with the accompanying drawings wherein.

DETAILED DESCRIPTION OF THE PREFERRED EMBODIMENTS

Figure 1:
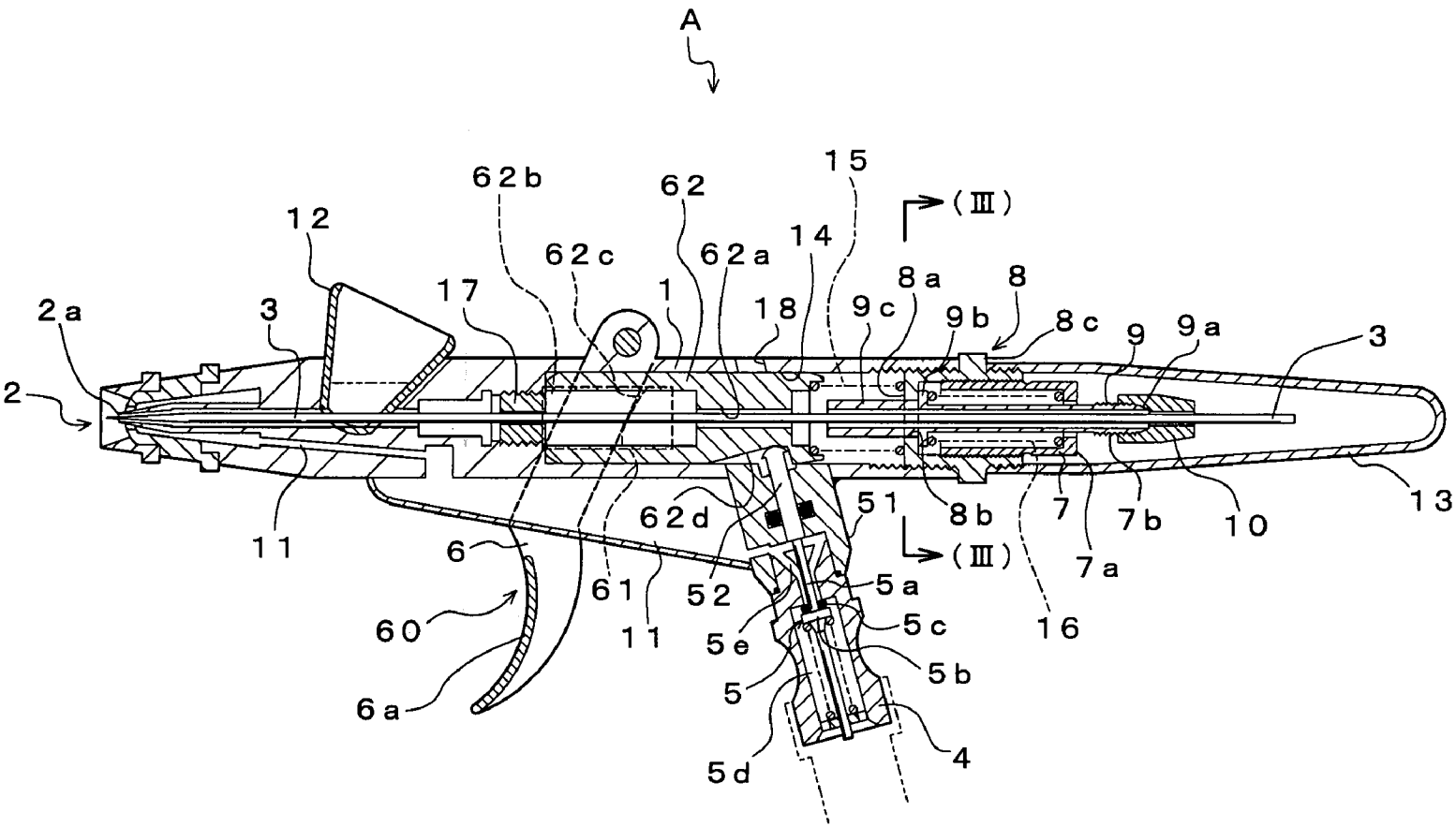
FIG. 1 is a longitudinal cross-sectional view of an air brush according to an embodiment of the present invention.
Figure 2:
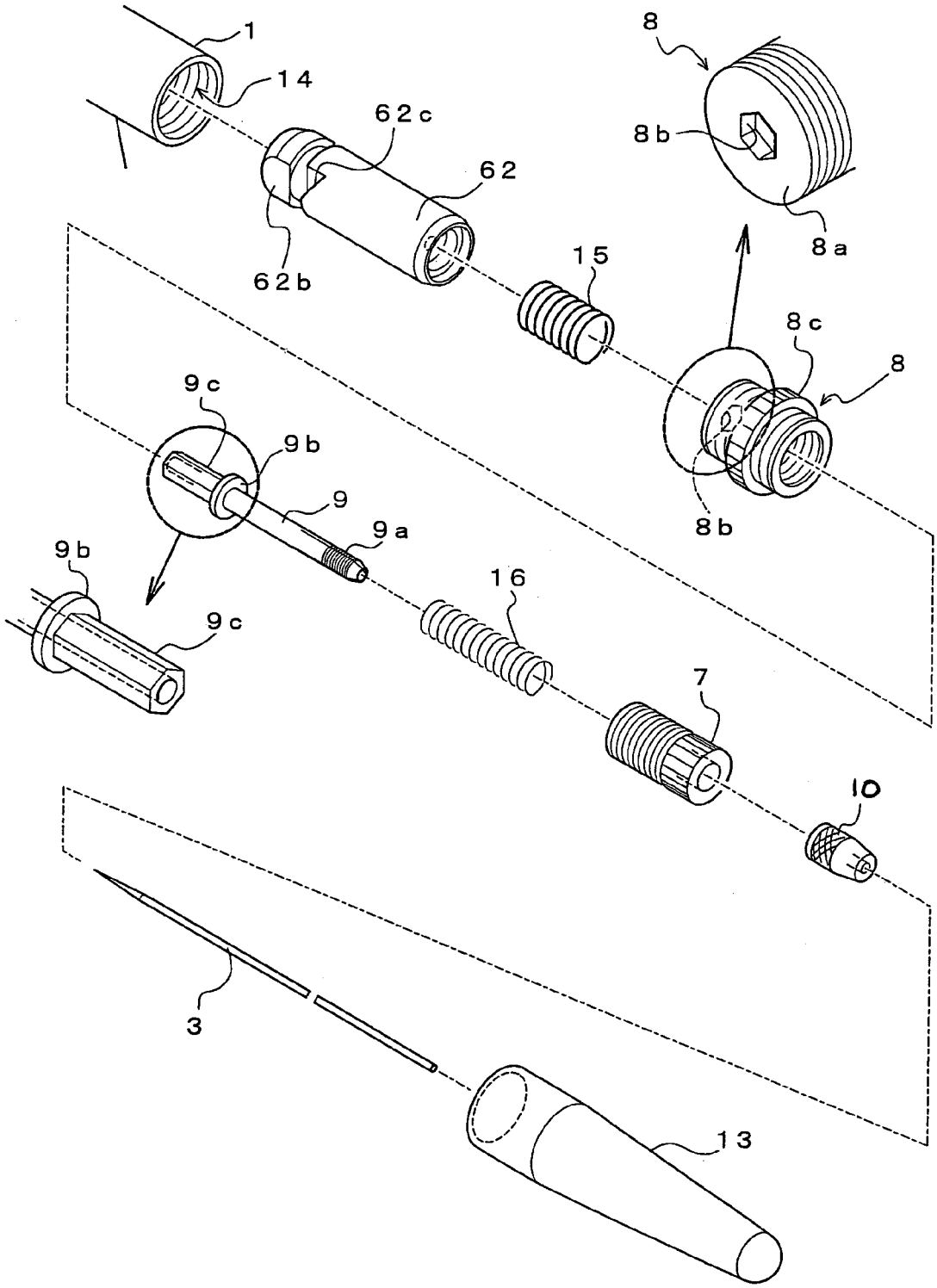
FIG. 2 is an exploded perspective view of a screw connection member of the air brush.
Figure 3:
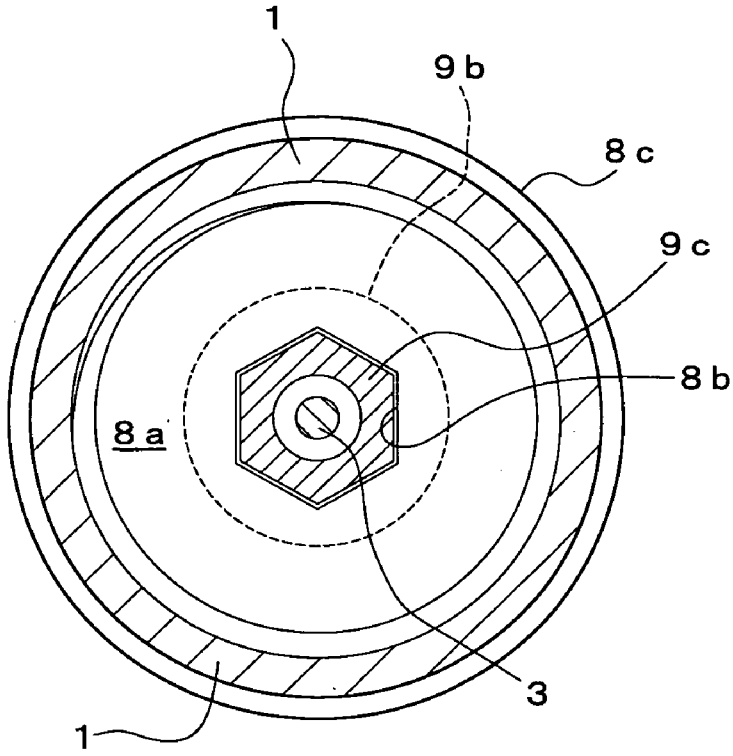
FIG. 3 is a cross-sectional view cut along a line III—III in FIG. 1.

Hereinbelow, a preferred embodiment of an air brush of the present invention will now be described in accordance with FIGS. 1 to 3. FIG. 1 shows a longitudinal cross section of an air brush A of the present invention. FIG. 2 shows an exploded view of a connection portion.

An air brush A has a trigger type finger hooking mechanism 60. A nozzle member 2 as a part to blow compressed air and liquid paint is provided at an end of an approximately-cylindrical air brush main body 1, and a needle 3 to arbitrarily open/close a nozzle 2*a* is inserted reciprocate-slidably along the axial center of the air brush main body 1.

When the needle 3 is withdrawn by pulling the lever 6, the liquid paint, supplied from a container 12 attached to a front part of the air brush main body 1, is blown-sprayed, with the compressed air supplied through an air valve 5, from the nozzle member 2.

A connection cylinder 4 as a connection orifice of a compressed air supply hose is screw-connected with a joint member 51 integrally connected with an intermediate part of the air brush main body 1, and the air valve 5 is provided inside the connection cylinder 4.

The air valve 5 is opened by pushing a valve stem 5*a* integrally having a valve body 5*b* downward thereby moving the valve body 5*b* away from a valve seat 5*c*. When the above air valve 5 is opened, the compressed air flows from a lower end orifice of the connection cylinder 4 as an air supply port toward the inside the air brush main body 1, then passes through a ventilation path 11 provided inside the air brush main body 1 and is blown out of the nozzle member 2.

Further, the valve stem 5*a* of the above air valve 5 is always pushed upward, i.e., toward the valve closing side, with a coil spring 5*d* elastically set on the lower surface side of the valve body 5*b*. In this arrangement, the upper side end of the above valve stem 5*a* is always in a state where it is projected upward in the axial center in a fork member 5*e* integrally formed in a central lower part of the air brush main body 1 (FIG. 1).

A valve rod 52, maintaining an air tight state, is slidably fit-inserted inside the joint member 51 screw-connected with the connection cylinder 4. The lower end of the valve rod 52 is in contact with the above valve stem 5*a*, and the air valve 5 is opened by push-down of the valve rod 52. A tail case 13 is removably screw-connected with the rear end opening of the air brush main body 1 via a screw connection member 8 to be described later such that the tail case covers an exposed portion from the rear end of the air brush main body 1 to the rear end of the needle 3.

On the other hand, the lever 6 is attached to an immediately front position of the air valve 5 of the air brush main body 1. The lever 6, having a trigger type finger hooking part 6*a*, branches into two parts expanding upward with release portions 61 on both right and left sides of the air brush main body 1 therebetween. An upper end of the lever 6 is pivotally supported with respect to a pivotal support member provided in an upper part of the air brush main body 1, and pivoted about the pivotal support member in a direction in which the finger hooking part 6*a* is pulled.

The lever 6, interlocked with a slide cam 62 provided inside the air brush main body 1, moves the needle 3 frontward/rearward toward the axial direction. The slide cam 62 is frontward/rearward slidably provided inside a cylindrical internal space 14 formed inside the air brush main body 1. The slide cam 62 has a hole 62*a* through which the needle 3 is inserted in its axial center, and has a flank surface 62*b* in contact with a side surface of the lever 6 and a cam surface 62*c* in contact with an edge of the lever 6. Further, a comparatively large-diameter coil spring 15 is elastically provided between the slide cam 62 and the screw connection member 8, to always elastically push the slide cam 62 and the lever 6 frontward.

Further, a tapered concave groove 62*d* is formed in a lower part of an outer peripheral surface of the slide came 62, and the upper end of the valve rod 52 is in contact with the concave groove 62*d*. In this arrangement, when the lever 6 is pulled, the slide cam 62 is slid rearward, then the valve rod 52 in contact with the concave groove 62*d* is gradually pushed, and the air valve 5 is opened in proportion to the amount of operation of the lever 6. Further, a stopper 17 to keep a liquid sealed state is screw-engaged with a front part of the internal space 14 of the air brush main body 1, and the needle 3 is inserted through the axial center.

The screw connection member 8 is a cylindrical member with a screw on its outer periphery. A front opening of the member is partitioned with a partition wall 8*a*, and a hexagonal insertion hole 8*b* through which a needle chuck 9 is fit-inserted is formed in the axial center of the member. Further, a convex-shaped partition rib 8*c* is provided around a intermediate part of the outer periphery having the screw, and knurling is formed around the outer periphery of the partition rib 8*c* such that it is slightly projected from the outer periphery of the rear end of the air brush main body 1. A spring case 7 is screw-engaged from a rear position in the rear end opening of the screw connection member 8.

The needle chuck 9 is fit-inserted in the spring case 7. The needle chuck 9 has a screw slotting at its rear end as a chuck member 9*a* to be screw-engaged with a needle stopper screw 10. Further, the needle chuck 9 has a rib 9*b* formed around its outer periphery on the front part side, and has a fit-insertion member 9*c* having a regular hexagonal cross-sectional shape in a position front of the rib 9*b*. In the needle chuck 9, the fit-insertion member 9*c* is inserted through the hexagonal insertion hole 8*b* formed in the screw connection member 8 from a rear position to bring the rib into contact with the partition wall 8*a*, thereby support the needle chuck unrotatably but slidably in a withdrawal direction utilizing the above fit-engagement relation (FIG. 3).

The spring case 7 is a case member having a partition wall 7*a* in its rear end opening and a screw formed around its front side outer periphery for screw-connection in the rear end opening of the above screw connection member 8. A hole 7*b* through which the needle chuck 9 is inserted is formed in the axial center of the partition wall 7*a* of the spring case 7, such that in an attached state, the coil spring 16 fitted in the needle chuck 9 inserted through along the axial center can be elastically provided between the partition wall 7*a* and the rib 9*b* of the needle chuck 9. In the attached state, the rear end of the needle 3 and the chuck member 9*a* of the needle chuck 9 are projected from the hole 7*b* at the rear end of the spring case 7, and the needle stopper screw 10 is screw-engaged with the chuck member 9*a* to fasten the chuck member 9*a*.

When the air brush A having the above structure is disassembled for maintenance or the like, the tail case 13 is turned and removed, and the needle stopper screw 10 of the exposed chuck member is removed. In this state, as the needle 3 can be pulled out in a rearward direction, the needle 3 is pulled out carefully. When the needle 3 has been pulled out, the screw-engagement of the spring case 7 is released, then is removed, with the coil spring 16, in the rearward direction, and at the same time, the needle chuck 9 is pulled out. In this state, cleaning of the needle, checking of the needle chuck, checking and cleaning of the coil spring 16, and the like, can be performed.

To further disassemble the air brush, the screw connection member 8 is removed from the rear end of the air brush main body 1 while it is turned, and the coil spring 15 is removed from the rear part of the opened air brush main body 1. In this state, to remove the slide cam 62, first, the connection cylinder 4 holding the air valve is removed from the joint member 51 of the air brush main body 1, and the valve rod 52 is moved downward. Then, the slide cam 62 can be pulled in the rearward direction.

In this manner, when the slide cam 62 has been removed from the air brush main body 1, the internal space 14 in the main body is opened, and the valve rod 52 can be pulled out of a pull-out hole 18 formed in the upper part of the air brush main body 1. Further, as the stopper 17 screw-engaged with the front end surface of the internal space 14 in the air brush main body 1 can appear, the engagement is released with a general driver inserted from the rear opening of the air brush main body 1, thereby the stopper 17 can be easily removed. In the above disassembly process, almost all the maintenance work regarding the inside of the air brush main body 1 can be performed. The labor of disassembly operation can be much reduced. Further, as maintenance work can be freely performed on the fine parts, even a user unaccustomed to disassembly can use the air brush always in good condition.

Figure 4:
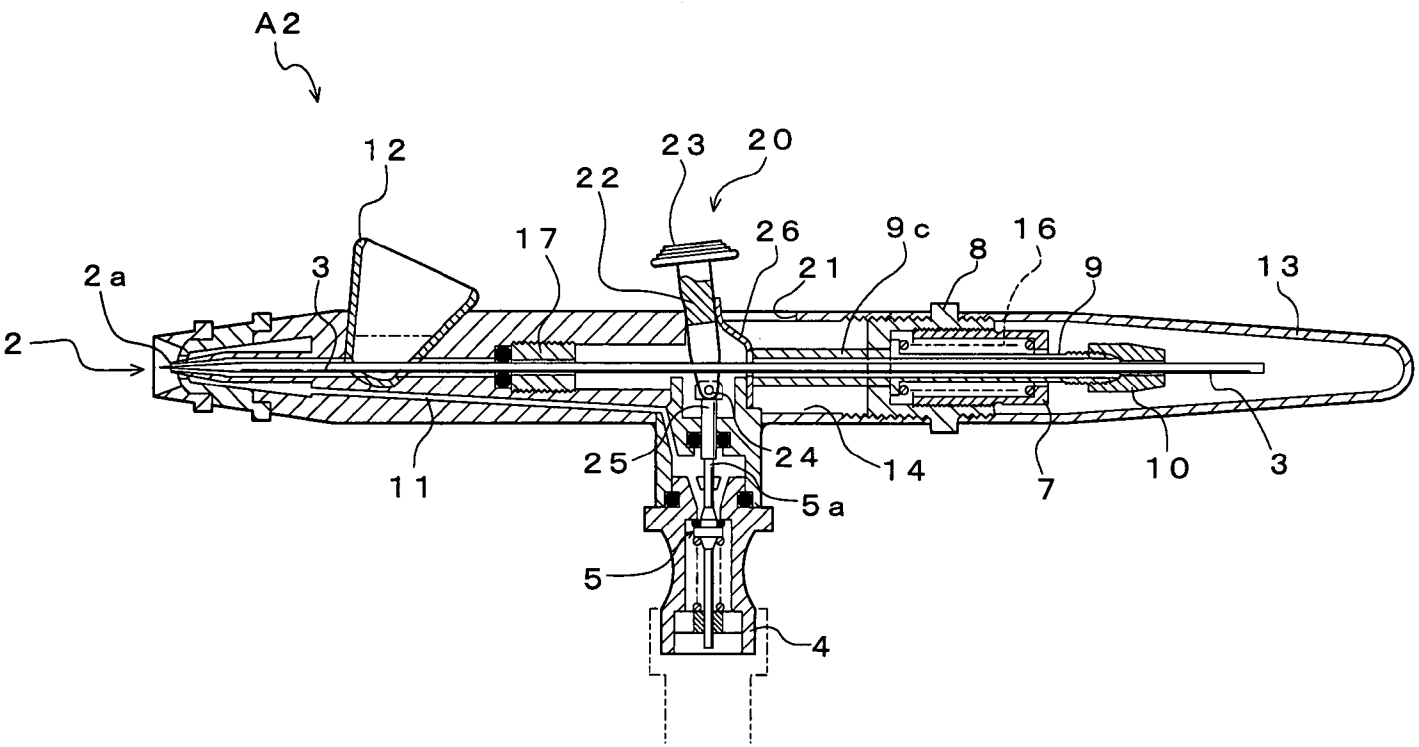
FIG. 4 is a longitudinal cross-sectional view of the air brush having a push-button type finger hooking mechanism.
Figure 5:
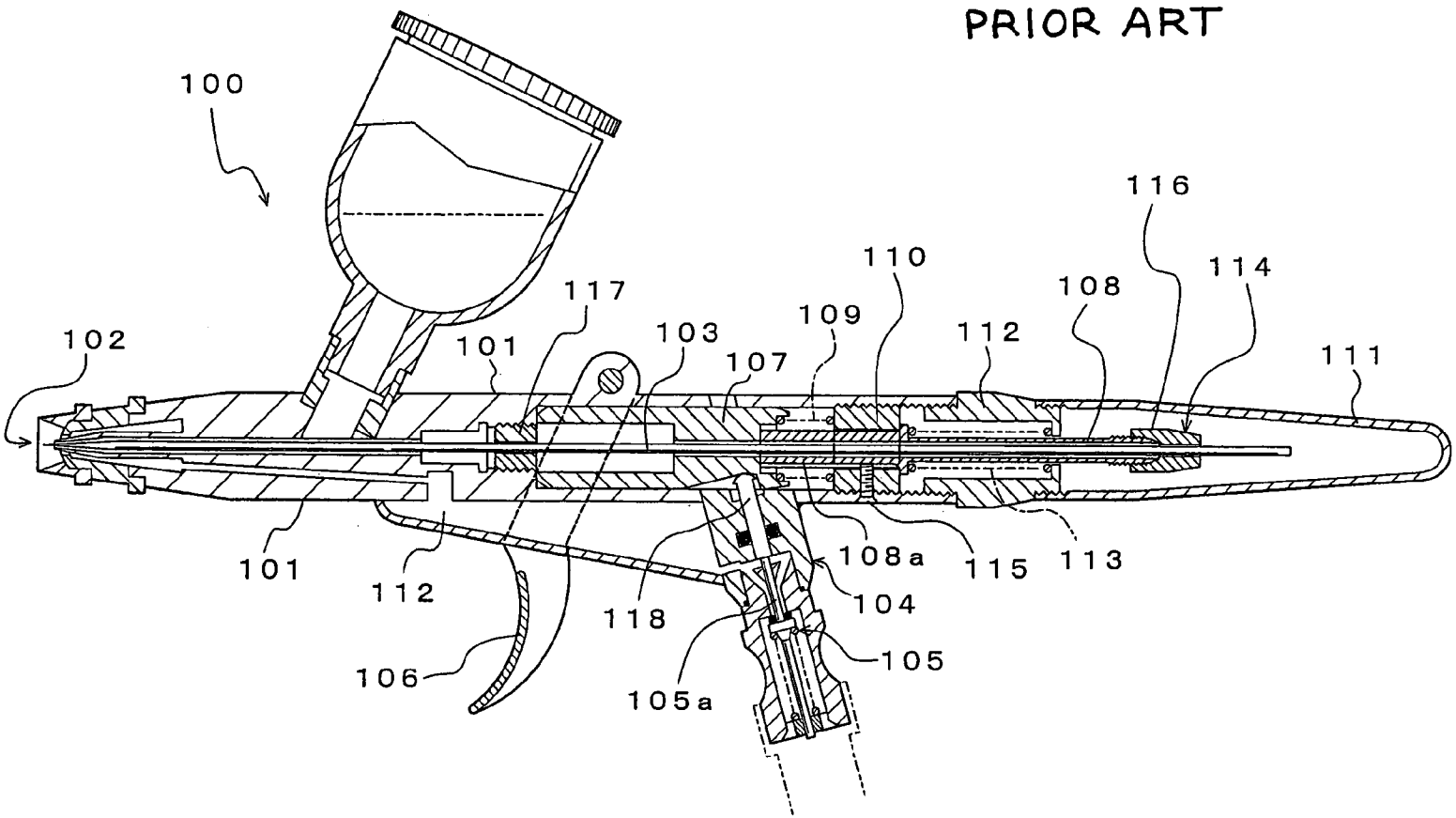
FIG. 5 is a longitudinal cross-sectional view of a conventional air brush.

Although an air brush A2 shown in FIG. 4 has a similar disassembly structure to that of the above-described air brush A, the air brush A2 has a push-button type finger hooking mechanism 20.

As in the case of the above air brush A, in the air brush A2, the air brush main body 1 and the tale case are detachably connected via the screw connection member 8. The screw-connection member 8 is screw-engaged with the spring case 7 in the state where the needle chuck 9 is fit-inserted and the coil spring 16 is elastically set in the screw connection member 8. Further, the needle stopper screw 10 is screw-engaged with the rear end of the needle chuck 9 projected from the spring case 7, to hold the needle 3.

On the other hand, a notched opening 21 is formed in the upper part of a central part of the air brush main body 1, and an operation stick 22 is fit-inserted from the notched opening and is attached push-operably. The operation stick 22 is provided with an operation button 23 on which a finger is hooked at an upper end, and its lower end as a fit-insertion end is connected with the upper end of a push stick 25 via a pivot member 24. The push stick 25 is in contact with the upper end of the valve stem 5*a* of the air valve 5. Further, an operation plate 26 bent in an approximate S-shape is in tiltably contact with the rear of the operation stick 22, and the needle 3 is inserted through an intermediate part of the operation plate 26. The end of the needle chuck 9 is in contact with the rear surface of the operation plate 26.

To blow the paint, the operation button 23 is depressed to blow the compressed air from the nozzle member 2, then the operation stick 22, with the operation button 23, is pulled rearward, to be tilted rearward with the pivot member 24 as a support point by a necessary amount. In correspondence with the tilting of the operation stick 22, the operation plate 13 is also tilted, and the needle chuck 9 holding the needle 3 is withdrawn. When the needle 3 is withdrawn, the paint is supplied by the amount in proportion to the amount of withdrawal to the nozzle 2*a*, and is blown out and sprayed from the nozzle member 2.

In the air brush A2 having the above structure, as in the case of the previously-described air brush A, when the screw connection member 8 is removed, the internal space 14 in the air brush main body 1 is opened, then the operation stick 22 and the operation plate 26 are removed, and the removal of the stopper 17, cleaning and grease-up of the insertion part of the push stick 25 can be freely performed.

Note that the needle chuck 9 of the air brush A and A2 is unrotatable but withdrawable in the axial direction by a fit engagement relation between the fit-insertion member 9*c* having a regular hexagonal cross-sectional shape and the insertion hole 8*b* through which the fit-insertion member is fit-inserted. The cross-sectional shape of the fit-insertion member 9*c* and the insertion hole 8*b* is preferably a regular hexagonal shape in consideration of stability upon processing and sliding. However, the cross-sectional shape is not limited to this shape. Similar operation can be performed even when the cross-sectional shape is other regular polygonal shapes such as regular pentagonal shape or regular octagonal shape, or regular triangular shape or square shape. Further, it may be arranged such that the fit-insertion member of the needle chuck is spline-engaged or an existing guide mechanism is provided thereby the needle chuck is supported unrotatably but slidably in the axial direction.

Further, the shape of the tail case connected with the rear part of the air brush main body 1 may be arbitrarily changed. Further, an adjusting screw to regulate a needle withdrawal position may be provided at the rear end of the tail case.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. An air brush, in which a needle to open and close a nozzle member is inserted reciprocably in an axial direction, along an axial center of an approximately long-cylindrical air brush main body having the nozzle member at its end, compressed air supplied via an air valve provided in an intermediate part of the air brush main body is blown out of the nozzle member, the air valve is opened and the compressed air is introduced into the nozzle member by operation of a finger hooking mechanism provided in the intermediate part of the air brush main body, and the needle is withdrawn in the axial direction to spray paint supplied to the nozzle member, with the compressed air, wherein a screw connection member is provided between the air brush main body and a tail case connected with a rear part of the air brush main body so as to detachably screw-connect both members, and a needle chuck to hold the needle inserted therein is inserted from a rear position to abut on the axial center of the screw connection member and supported unrotatably but withdrawably in the axial direction; a spring case is fitted around an outer periphery of the needle chuck and is screw-engaged in a rear opening of the screw connection member, and a coil spring is elastically set in the spring case to always push the needle chuck toward a frontward direction; and a needle stopper screw is screw-engaged with the needle chuck projected from the spring case in a rearward direction.

2. The air brush according to claim 1, wherein the finger hooking mechanism is a trigger type mechanism.

3. The air brush according to claim 1, wherein the finger hooking mechanism is a push-button type mechanism.

4. The air brush according to of claims 1, wherein a cross-sectional shape of a fit-insertion member of the needle chuck and an engagement hole of the screw connection member is a regular polygonal shape.

5. The air brush according to claims 2, wherein a cross-sectional shape of a fit-insertion member of the needle chuck and an engagement hole of the screw connection member is a regular polygonal shape.

6. The air brush according to claims 3, wherein a cross-sectional shape of a fit-insertion member of the needle chuck and an engagement hole of the screw connection member is a regular polygonal shape.

* * * * *